US010035074B1

(12) United States Patent
Mucaro

(10) Patent No.: US 10,035,074 B1
(45) Date of Patent: Jul. 31, 2018

(54) MOTORIZED TOY VEHICLE WITH IMPROVED TRACTION WHEELS AND SURFACE GUIDANCE SYSTEM

(71) Applicant: Salvatore Mucaro, Fernandina Beach, FL (US)

(72) Inventor: Salvatore Mucaro, Fernandina Beach, FL (US)

( * ) Notice: Subject to any disclaimer, the term of this patent is extended or adjusted under 35 U.S.C. 154(b) by 0 days.

(21) Appl. No.: 15/730,007

(22) Filed: Oct. 11, 2017

Related U.S. Application Data

(63) Continuation-in-part of application No. 15/724,390, filed on Oct. 4, 2017.

(60) Provisional application No. 62/478,086, filed on Mar. 29, 2017.

(51) Int. Cl.

| | |
|---|---|
| ***A63H 18/00*** | (2006.01) |
| ***A63H 18/04*** | (2006.01) |
| ***A63H 17/26*** | (2006.01) |
| ***A63H 18/08*** | (2006.01) |
| ***A63H 17/00*** | (2006.01) |
| ***A63H 18/02*** | (2006.01) |

(52) U.S. Cl.
CPC ..... *A63H 18/08* (2013.01); *A63H 17/004* (2013.01); *A63H 17/262* (2013.01); *A63H 18/00* (2013.01); *A63H 18/021* (2013.01); *A63H 18/04* (2013.01)

(58) Field of Classification Search
CPC ..... A63H 18/028; A63H 18/04; A63H 21/02; A63H 21/04; A63H 18/00; A63H 18/02; A63H 18/08; A63H 17/262
See application file for complete search history.

(56) References Cited

U.S. PATENT DOCUMENTS

| | | | | |
|---|---|---|---|---|
| 1,566,492 | A * | 12/1925 | McGinness | B61C 11/04 105/30 |
| 2,541,514 | A * | 2/1951 | Herold | B60B 33/0002 104/306 |
| 2,575,055 | A * | 11/1951 | Jaeger | A63H 18/021 104/245 |
| 2,821,938 | A * | 2/1958 | Muller | A63H 18/021 104/245 |
| 3,451,161 | A * | 6/1969 | Lemelson | A63H 18/14 446/138 |
| 4,561,656 | A | 12/1985 | David | |
| 4,571,204 | A | 2/1986 | Wang | |
| 5,421,762 | A | 6/1995 | Glickman | |
| 2010/0285719 | A1* | 11/2010 | Laurienzo | A63H 17/26 446/444 |
| 2012/0052766 | A1* | 3/2012 | Payne | A63H 18/028 446/444 |

* cited by examiner

*Primary Examiner* — Gene Kim
*Assistant Examiner* — Alyssa Hylinski
(74) *Attorney, Agent, or Firm* — Thomas C. Saitta

(57) ABSTRACT

An improved traction wheel structure for a motorized toy vehicle adapted to travel along tracks, rails, wires, strings or the like having vertical top edges or diameters, the wheels being provided with a V-shaped annular traction channel defined by laterally extending traction members extending from the sides of a primary annular channel. The toy vehicle is part of a set having at least two track members with vertical top edges, the track members being connected by a surface guide member.

13 Claims, 8 Drawing Sheets

MOTORIZED TOY VEHICLE WITH IMPROVED TRACTION WHEELS AND SURFACE GUIDANCE SYSTEM

This application is a continuation-in-part application of U.S. Non-Provisional patent application Ser. No. 15/724,390, filed Oct. 4, 2017, and claiming the benefit of U.S. Provisional Patent Application Ser. No. 62/478,086, filed Mar. 29, 2017.

BACKGROUND OF THE INVENTION

This application relates generally to the field of motorized, wheeled toy vehicles, and more particularly relates to such toy vehicles adapted to travel along tracks, rails, wires or the like.

Motorized, wheeled toy vehicles are well known. The toy vehicles may be powered by mechanical wind-up mechanisms, battery powered motors, electric powered motors, etc. The toys may be adapted for unrestricted travel, for travel on tracks, rails, wires or the like, for radio-controlled travel, etc.

Many such toy vehicles travel along tracks, rails, wires or the like, such that the layout of the tracks, etc., determines the travel pathway of the toy vehicle. In certain instances, the tracks provide a pair of vertically-extending, laterally-paired, external boundary members (e.g., walls, bumpers, etc.) to control directional movement, whereby the wheels of the toy vehicles roll between the lateral boundaries such that the exterior sides of the wheels or toy vehicle will contact the boundaries, thereby precluding unwanted lateral deviation of the vehicle from the track pathway. In other instances, the wheels of the toy vehicles ride atop a pair of elongated top edges of the tracks or rails, the wheels of the toy vehicle being structured such that an annular flange or rim extends radially outside of the annular contact surface of the wheel, i.e., the flange/rim has a large diameter than the main portion of the wheel, such that the paired flanges preclude excessive lateral movement relative to the track or rails, such as for example as found in a traditional electric train set.

In other instances, each wheel of a toy vehicle is provided with an annular channel extending around the circumference of the wheel, such that each channel defines an interior contact surface bounded by two flanges or rims. The combination of contact surface and paired flanges define a generally C-shaped or U-shaped annular channel. Such a construction allows the wheels to travel on tracks or rails having a pair of thin, vertical walls or structures presenting a pair of narrow edges or runners, as well as allowing travel on a pair of wires or strings. The separation distance between the top edges or runners is equal to the distance between the channels of each transverse wheel pair. With wheels of this design, the toy vehicles may also travel on horizontal surfaces without tracks, rails, wires, strings, etc.—the outer perimeter of the flanges acting as the wheel contact surfaces for the horizontal surface. The channels of the toy vehicle wheels may be square, rectangular, U-shaped or V-shaped.

It is an object of this invention to provide an improved wheel structure for channeled wheels, the improved structure providing greater traction between the wheels and the track, rails, wires, strings, etc., such that the motorized toy vehicles are able to traverse over relatively steep inclined tracks, rails, walls, wires, strings, etc. It is a further object to provide a set of track members and a surface guidance system whereby the travel pathway between track members on a horizontal surface is controlled by the surface guidance system.

SUMMARY OF THE INVENTION

Figure 2:
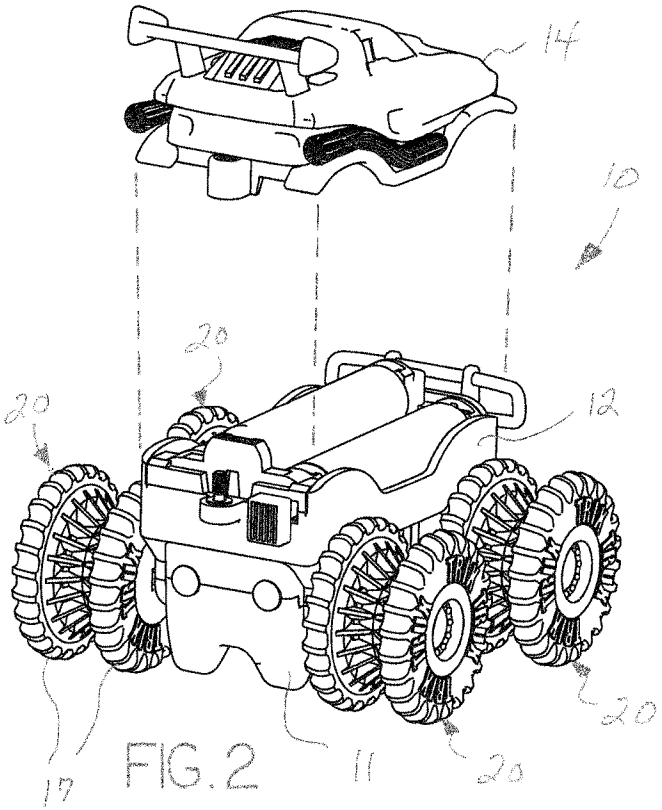
FIG. 2 is an exploded perspective rear view of the embodiment of FIG. 1.
Figure 1:
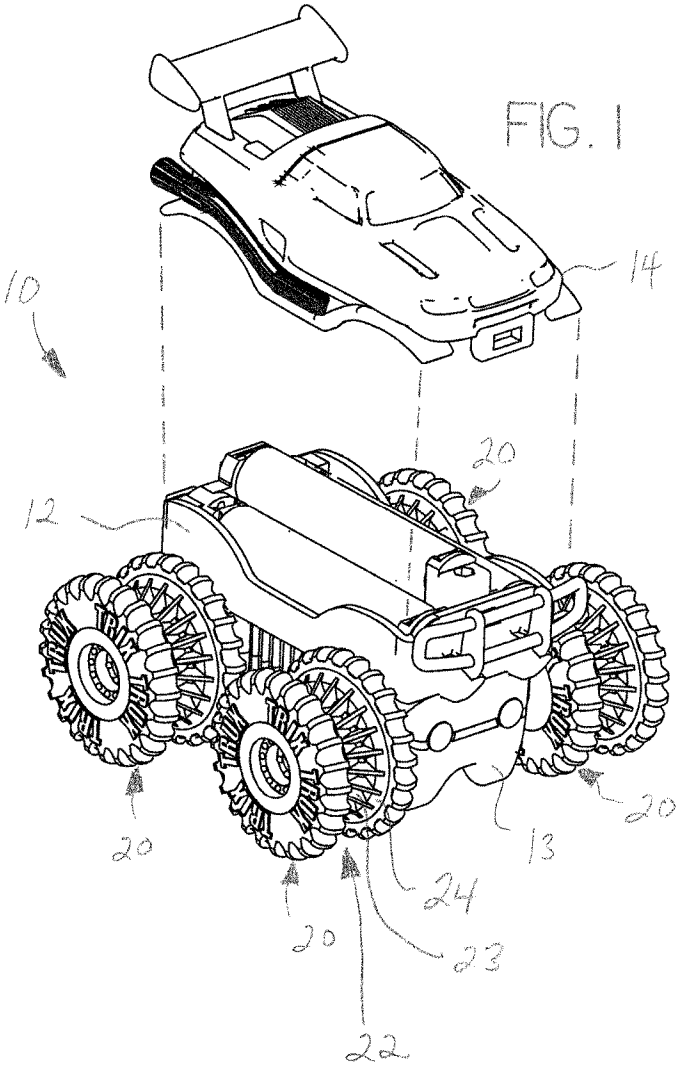
FIG. 1 is an exploded perspective front view showing an embodiment of a toy vehicle with wheels having the improved traction members, the decorative cover being removed from the upper base cover.
Figure 3:
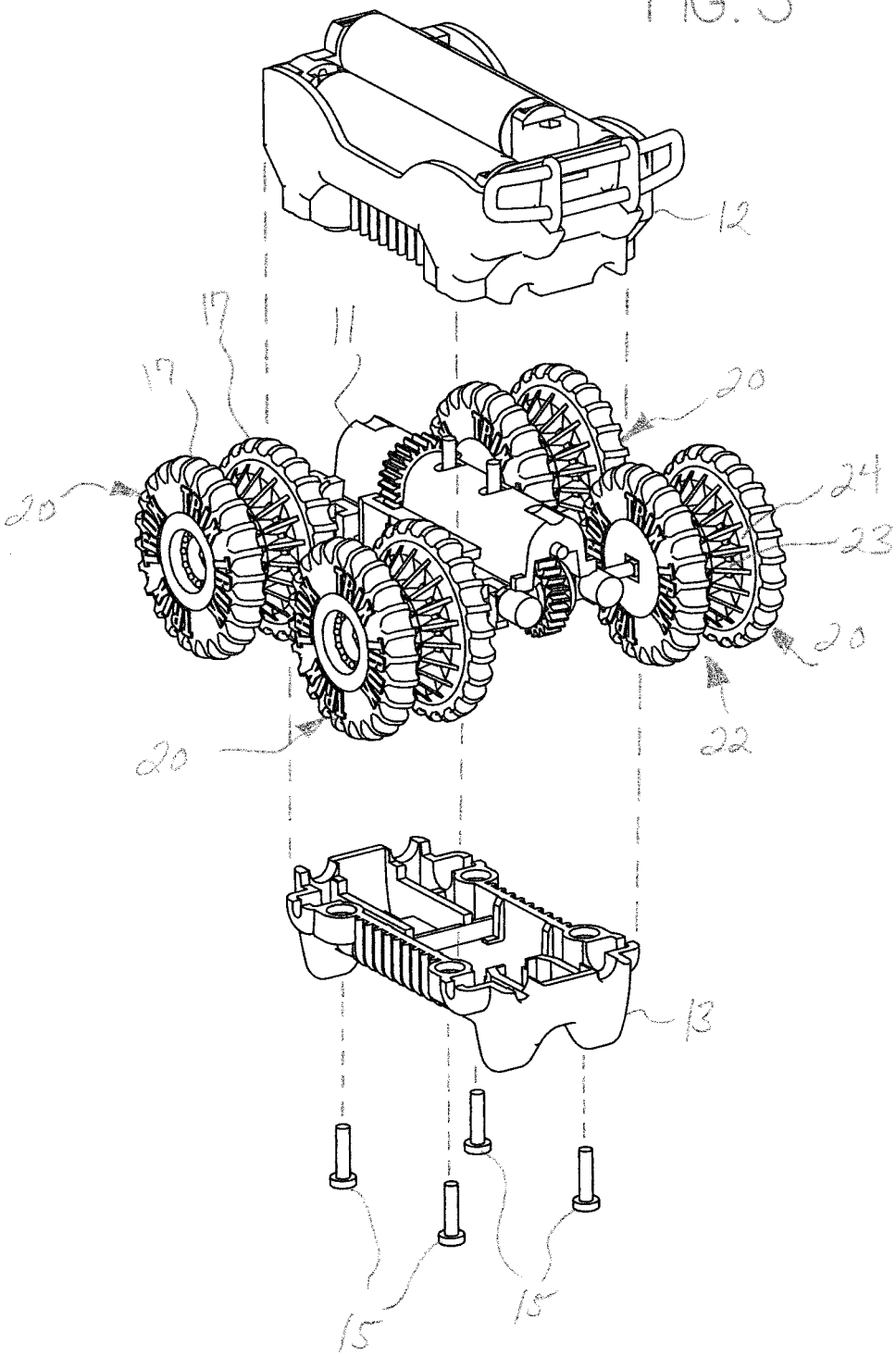
FIG. 3 is an exploded perspective view of the embodiment of FIG. 1 showing the upper base member and lower base member separated from the chassis motor assembly.

The invention in various embodiments comprises an improved wheel structure for motorized, wheeled toy vehicles—the vehicles having wheels with annular channels adapted to receive and travel along a pair of parallel, spaced tracks, rails, wires, strings or the like (referred to herein collectively as "track members") that present narrow top edges or diameters (referred to herein as a Vertical Top Edges—VTE's). The annular channels are sized to receive the VTE's as the toy vehicle travels along the track members. The sides of the channels are provided with internally extending, opposing traction members, the traction members being physical structures or members that increase traction between the wheels and the narrow VTE's of the track members. The traction members in a most preferred embodiment are inwardly facing, opposing ridges or ribs extending longitudinally in the radial direction from the wheel central axis, the surfaces of which are dimensioned to define a V-shaped traction channel within the rectilinear, U-shaped or V-shaped primary channel. Preferably, the toy vehicle is provided with an underside channel or slot adapted to receive a tubular surface guide member, wherein the surface guide member defines the pathway for the toy vehicle when the vehicle is on a horizontal surface and not on a VTE track member.

In alternative language the invention may be summarized as a motorized wheeled toy vehicle and track member set comprising at least two track members, each said track member comprising a pair of parallel spaced vertical top edges; at least one surface guide member connecting said at least two of said track members, said at least one surface guide member being a flexible, elongated member; a motorized toy vehicle comprising a plurality of laterally paired wheels, each wheel comprising an annular primary channel adapted to receive one of said vertical top edges, and each wheel further comprising a traction channel disposed within said primary channel, the traction channel defined by laterally extending, opposing traction members positioned within said primary channel, said toy vehicle further comprising an underside guide slot; wherein said at least one surface guide member is received within said underside guide slot such that the travel pathway of said toy vehicle is determined by said at least one surface guide member when said toy vehicle is traveling between said at least two track members. Furthermore, such invention wherein one of said at least two track members comprises a pair of laterally spaced rails; wherein one of said at least two track members comprises a pair of laterally spaced strings or wires; wherein one of said at least two track members comprises a pair of laterally spaced walls having undulating vertical track edges; wherein each said traction channel is V-shaped; wherein each said wheel comprises a wheel axis, and each said traction channel widens as the distance from said wheel axis increases; wherein each said wheel comprises a wheel axis, and the lateral dimension of each said traction member decreases as the distance from said wheel axis increases; wherein each said wheel comprises a wheel axis, and each said traction members are ridges extending in the radial direction from said wheel axis; wherein each said traction member is composed of a polymer material; wherein said at least one surface guide member is circular in cross-section; wherein said at least one surface guide member is tubular; and/or wherein said at least one surface guide member is tubular and wherein each of said at least two track members comprises a post, and wherein said at least one surface guide member is connected to said post of each of said at least two track members.

DETAILED DESCRIPTION OF THE INVENTION

The embodiments of the invention will now be described in detail with reference to the drawings. The drawings are for descriptive and disclosure purposes for better understanding of the structural elements and are not intended to be limiting as to the scope of the claimed invention. Directional terms such as front, rear, forward, backward or the like shall reference the direction of travel of the toy vehicle 10, while terms such as lateral, transverse or the like shall reference the direction perpendicular to the direction of travel.

The invention in various embodiments comprises an improved wheel structure for motorized, wheeled toy vehicles 10—the vehicles 10 having sets of paired wheels 20 with annular primary channels 24 adapted to receive and travel along a pair of spaced tracks, rails, wires, strings or the like (hereinafter referred to collectively as "track members 92") that present narrow top edges or diameters 93 that are received within the annular primary channels 24. For ease of reference herein, the term "VTE track members" shall be used herein to include tracks, rails, walls, wires, strings or the like 92 wherein a pair of equally spaced, parallel, vertical top edges 93 ("VTE") is presented to the channeled wheels 20 of the motorized toy vehicle 10, the sizing and lateral spacing of the VTE's 93 and the primary channels 24 being appropriately chosen such that the VTE's 93 are received within the annular primary channels 24 when the toy vehicle 10 travels along the VTE track members 92.

As shown best in FIGS. 1-4, a representative motorized toy vehicle 10 may comprise the combination of a motor chassis assembly 11, an upper base member 12 and lower base member 13 encasing the motor chassis assembly 11, and a decorative cover 14 positioned on the upper base member 13, the components being joined by various mechanical fasteners 15, clip structures or the like. In this representative embodiment, the toy vehicle 10 is battery powered. The particular ornamental design of the toy vehicle 10 is not critical to the invention.

Figure 4:
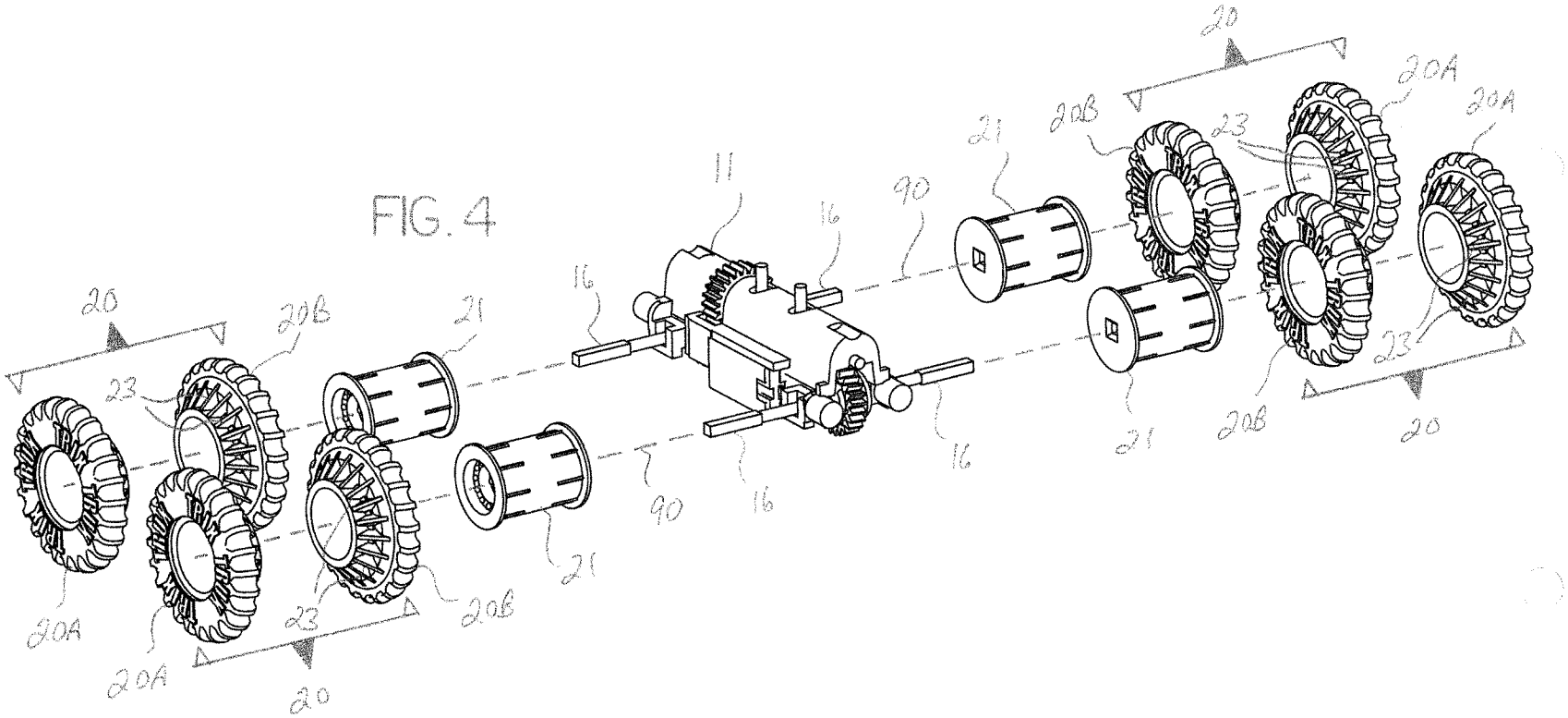
FIG. 4 is an exploded perspective view of the embodiment of FIG. 1, showing the wheel assemblies separated from the motor chassis assembly.

As shown in FIG. 4, the toy vehicle 10 comprises two sets of laterally spaced wheels 20 that are mounted onto drive axles 16 extending laterally from the motor chassis assembly 11, such that the toy vehicle 10 has a total of four wheels 20 and mimics a typical car or truck. The wheels 20 may be formed in various ways, one such design being illustrated herein as a representative assembly such that each wheel 20 comprises a wheel outer half 20A and a wheel inner half 20B, which are combined and mounted onto a hub 21. Alternatively, each wheel 20 may be formed as a unitary member. Each wheel 20 comprises an annular or circumferential primary channel 24 that defines two flanges 17 on each wheel 20.

Figure 5:
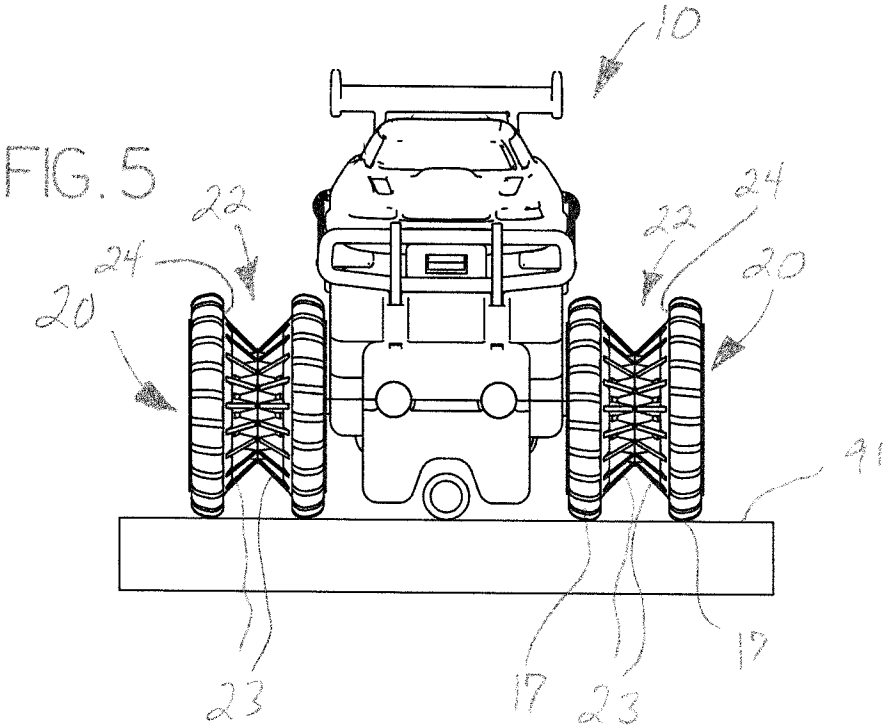
FIG. 5 is a front view of the embodiment of FIG. 1 traveling on a horizontal surface.

The annular primary channel 24 may be rectilinear, U-shaped or V-shaped, and the flanges 17 of the wheels 20 may be narrow or broad, such that the primary channel 24 may occupy a majority or a minority of the overall lateral dimension of the wheel 20. The flanges 17 define or are a component of the contact surface of the wheel 20, the contact surface being the surface that makes contact with a horizontal surface 91, such as the ground, floor, a table top, etc., as seen in FIG. 5. The peripheral contact surfaces of wheel 20 may be provided with grooves, treads or the like in the manner of actual vehicle tires to increase traction on the horizontal surface 91.

To improve traction, i.e., increase the grip of the wheels 20 on the VTE track members 92 such that steep climbs are possible, the sides of the primary channels 24 are provided with opposing traction members 23, the traction members 23 being physical structures or members that extend toward each other from the sides or walls of the primary channel 24. Thus, the traction members 23 extend from the sides of the primary channel 24 laterally (i.e., in a direction parallel to the wheel axis 90), thereby narrowing the width of the primary channel 24.

The traction members 23 present physical projections, protrusions, edges or the like which are adapted to receive and come into contact with the VTE's 93 when the toy vehicle 10 travels along the VTE track members 92. In a most preferred embodiment the traction members 23 comprise elongated ridges or ribs extending laterally from each wall of the primary channel 24 toward the center of the primary channel 24. The traction members 23 are oriented longitudinally in the radial direction from the central axis 90 of the wheel 20. The contact surfaces of the tractions members 23 are preferably structured so as to define a V-shaped traction channel 22 within the primary channel 24, the traction channel 22 being widest at its exterior and narrowing in the inward direction toward the wheel axis 90. This structure is accomplished by shortening the lateral dimension of the traction elements 23 as the distance from the wheel axis 90 increases.

Figure 7:
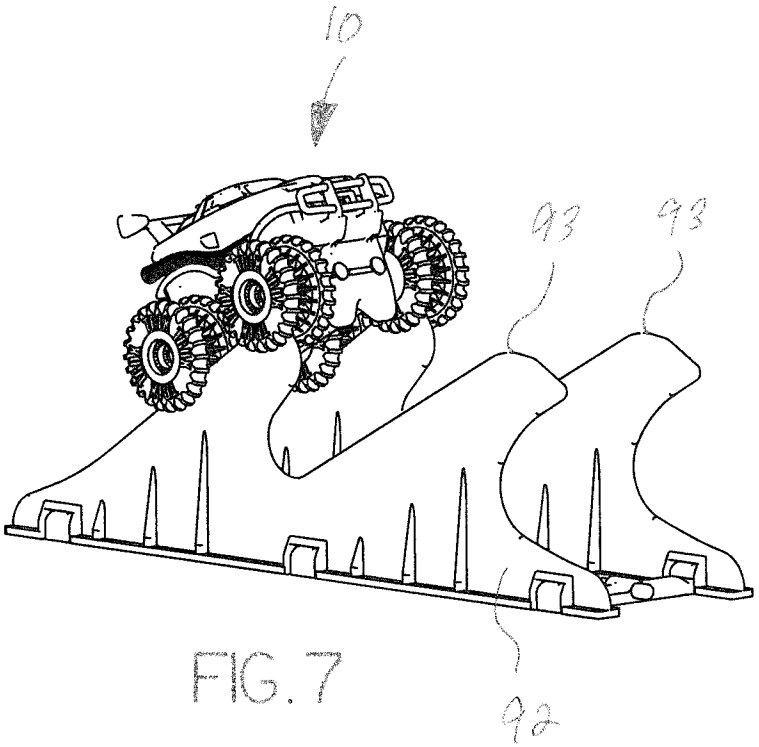
FIG. 7 is a perspective view of the embodiment of FIG. 1 traveling along VTE's comprising upstanding walls in an undulating pattern.
Figure 6:
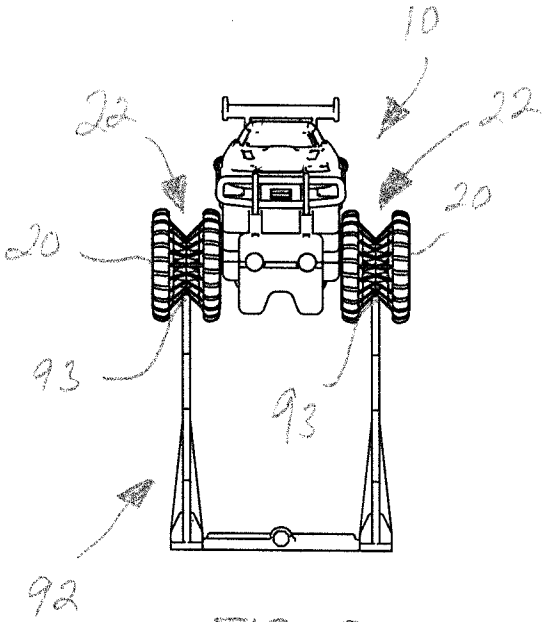
FIG. 6 is a front view of the embodiment of FIG. 1 traveling along a vertical top edge (VTE) track member comprising upstanding walls.
Figure 8:
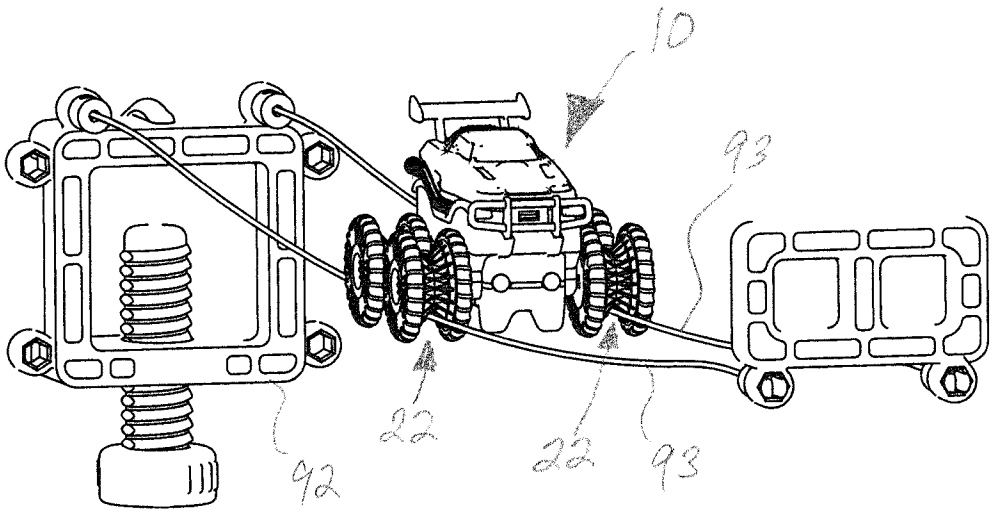
FIG. 8 is a perspective view of the embodiment of FIG. 1 traveling along VTE's comprising a pair of strings or wires.
Figure 9:
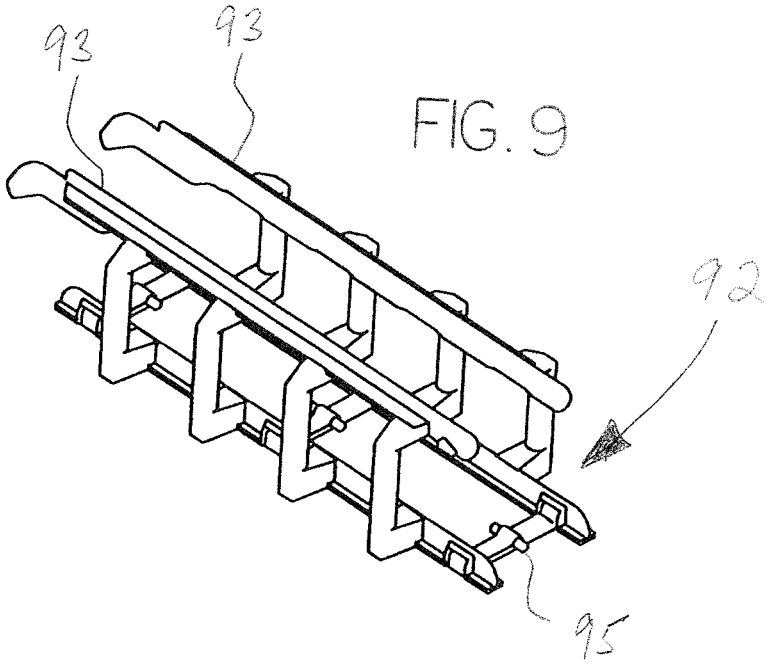
FIG. 9 is a perspective view of a VTE track member comprising a pair of raised rails.

The traction members 23 on each side of the primary channel 24 may be arranged so as to directly face each other or to be offset or alternating, the offset or alternating arrangement being preferred as this especially increases traction when the VTE track members 92 are composed of non-rigid wires or strings, as shown in FIG. 8, or paired vertical walls having an undulating or non-linear VTE 93, as shown in FIG. 7. The V-shape of the traction channel 22 creates a wedging effect that reduces slippage as the wheels 20 turn, the weight of the toy vehicle 20 insuring that the wheels 20 fully seat onto the VTE track members 92.

While the material of construction for the wheels 20 and/or the traction members 23 is not critical, a polymer material is preferred over a metal or ceramic material, as the polymer material provides low material costs and manufacturing process costs, provides higher surface friction properties, and allows for great variety in both functional and decorative design. The density, tackiness, compressibility and surface texture of the polymer material can be varied as desired to increase traction, with a softer polymer material being preferred.

While the VTE track members 92 may define an elongated pathway that is unidirectional or loops back upon itself to define a continuous pathway, the preferred embodiment of the invention comprises combination of various individual "stunt" VTE track members 92, such as shown in FIGS. 7-10. The particular configuration of the stunt VTE track members 92 will cause the toy vehicle 10 to flip, face-plant, nose-dive, travel above ground, etc. as it maneuvers over each stunt VTE track member 92, such tricks being made possible by the increased traction of the vehicle wheels 20 on the VTE's 93.

Figure 10:
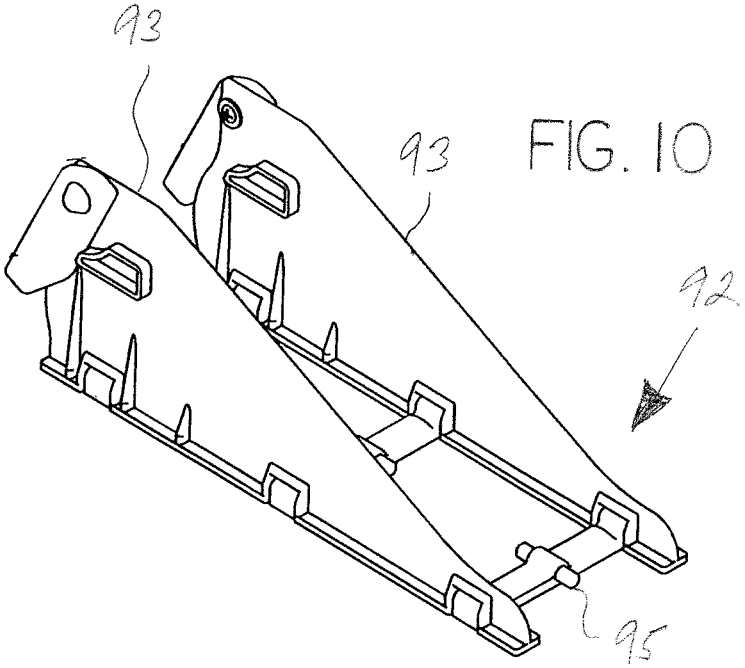
FIG. 10 is a perspective view of a VTE track member comprising a pair of inclined rails.
Figure 11:
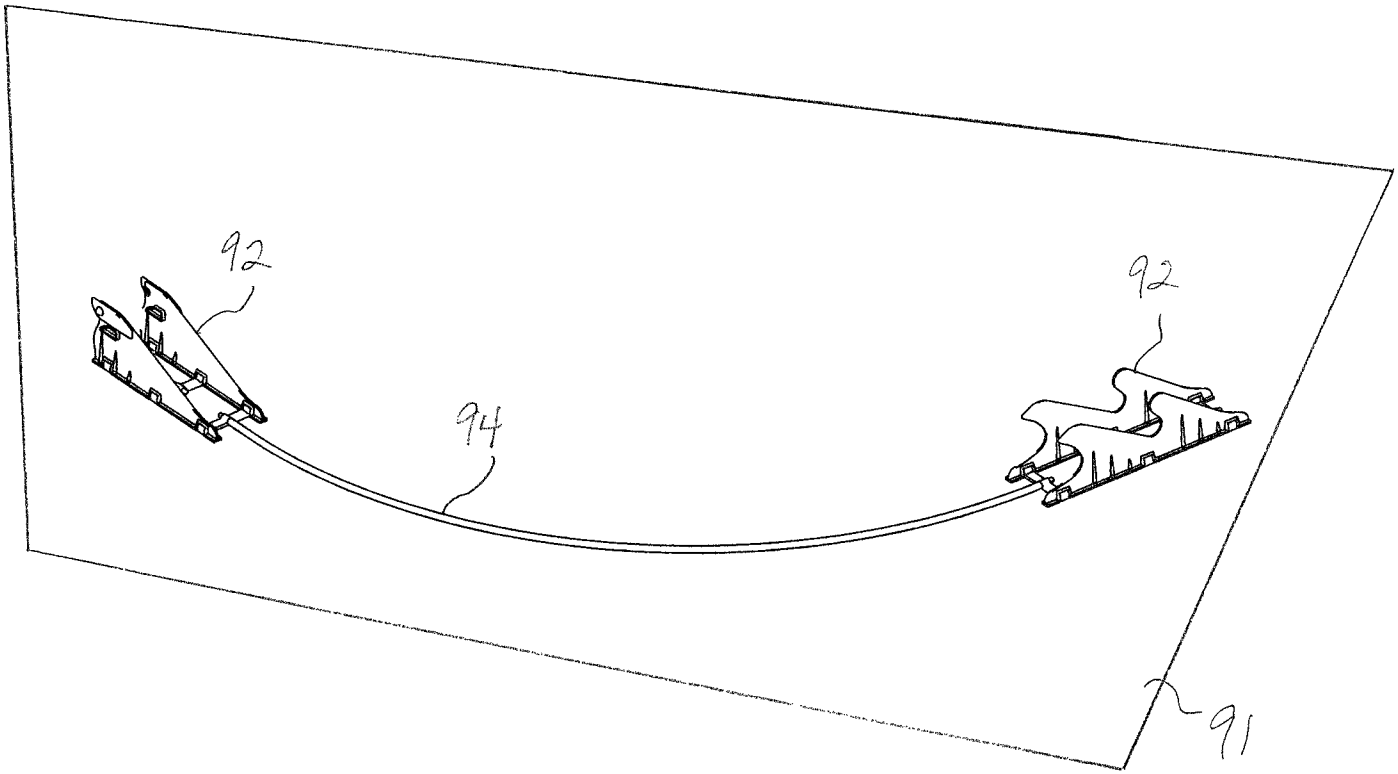
FIG. 11 is a view showing two VTE track members connected by a surface guide member.

In another preferred embodiment, the various VTE track members 92 are connected in sequence using a surface guide system comprising an elongated surface guide member 94, as shown in FIG. 10. The surface guide member 94 is preferably composed of a flexible or malleable material, e.g., a polymer, formed as a tubular or rod-like member, i.e., is circular in cross-section, such that alterations of the travel pathway on the horizontal surface 91 are easily accomplished. For a tubular member, the individual stunt VTE track members 92 may be provided with posts 95 such that the ends of each segment of the surface guide members 94 can be mounted thereon. In this manner a series of VTE track members 92 may be joined to form an elongated surface travel pathway with multiple stunt sections. For this embodiment, the toy vehicle 10 is provided with an underside guide slot 18 extended beneath or formed as a part of the lower base member 12. The guide slot 18 and surface guide member 94 are appropriately sized such that the surface guide member 95 is received within the guide slot 18 as the vehicle 10 travels across a horizontal surface 91. In this manner the toy vehicle 10 will follow the pathway defined by the surface guide member 95 from one VTE track member 92 to another VTE track member 92, the sides of the guide slot 18 precluding the toy vehicle 10 from free travel.

It is to be understood that equivalents and substitutions for certain elements as described above may be obvious to those of skill in the art, and therefore the true scope and definition of the invention is to be as set forth in the following clams.

I claim:

1. A motorized wheeled toy vehicle and track member set comprising:

at least two track members, each said track member comprising a pair of parallel spaced vertical top edges;

at least one surface guide member connecting said at least two of said track members, said at least one surface guide member being a flexible, elongated member disposed on a horizontal surface between said at least two track members;

a motorized toy vehicle comprising a lower base member and a plurality of laterally paired wheels, each said wheel being mounted onto a drive axle and comprising an annular primary channel adapted to receive one of said vertical top edges, and each said wheel further comprising a traction channel disposed within said primary channel, the traction channel defined by laterally extending, opposing traction members positioned within said primary channel, said toy vehicle further comprising an underside guide slot disposed on said lower base member;

wherein said motorized toy vehicle is adapted to travel with said vertical top edges received within said annular primary channels when said motorized toy vehicle is located on one of said at least two track members, and further wherein said motorized toy vehicle is adapted to travel on the horizontal surface when said motorized toy vehicle is located between said at least two track members;

wherein said at least one surface guide member is received within said underside guide slot such that the travel pathway of said toy vehicle is determined by said at least one surface guide member when said toy vehicle is traveling on the horizontal surface between said at least two track members.

2. The toy vehicle and track member set of claim 1, wherein one of said at least two track members comprises a pair of laterally spaced rails.

3. The toy vehicle and track member set of claim 1, wherein one of said at least two track members comprises a pair of laterally spaced strings or wires.

4. The toy vehicle and track member set of claim 1, wherein one of said at least two track members comprises a pair of laterally spaced walls having undulating vertical track edges.

5. The toy vehicle and track member set of claim 1, wherein each said traction channel is V-shaped.

6. The toy vehicle and track member set of claim 1, wherein each said wheel comprises a wheel axis, and each said traction channel widens as the distance from said wheel axis increases.

7. The toy vehicle and track member set of claim 1, wherein each said wheel comprises a wheel axis, and the lateral dimension of each said traction member decreases as the distance from said wheel axis increases.

8. The toy vehicle and track member set of claim 1, wherein each said wheel comprises a wheel axis, and each said traction members are ridges extending in the radial direction from said wheel axis.

9. The toy vehicle and track member set of claim 1, wherein each said traction member is composed of a polymer material.

10. The toy vehicle and track member set of claim 1, wherein said at least one surface guide member is circular in cross-section.

11. The toy vehicle and track member set of claim 1, wherein said at least one surface guide member is tubular.

12. The toy vehicle and track member set of claim 1, wherein said at least one surface guide member is tubular and wherein each of said at least two track members comprises a post, and wherein said at least one surface guide member is connected to said post of each of said at least two track members.

13. The toy vehicle and track member set of claim 1, wherein said at least one surface guide member is non-linear.

* * * * *